US011842711B1

(12) United States Patent
Hearn et al.

(10) Patent No.: US 11,842,711 B1
(45) Date of Patent: Dec. 12, 2023

(54) METHOD AND SYSTEM FOR SIMULATING MUSICAL PHRASE

(71) Applicant: STAFFPAD LIMITED, London (GB)

(72) Inventors: David William Hearn, London (GB); Matthew Tesch, Pittsburgh, PA (US)

( * ) Notice: Subject to any disclaimer, the term of this patent is extended or adjusted under 35 U.S.C. 154(b) by 23 days.

(21) Appl. No.: 18/061,049

(22) Filed: Dec. 2, 2022

(51) Int. Cl.
*G10H 1/00* (2006.01)

(52) U.S. Cl.
CPC ..... *G10H 1/0025* (2013.01); *G10H 1/0041* (2013.01); *G10H 2210/111* (2013.01); *G10H 2210/131* (2013.01); *G10H 2240/145* (2013.01); *G10H 2250/105* (2013.01)

(58) Field of Classification Search
CPC .. G10H 1/0025; G10H 2240/145; G10H 1/26; G10H 1/0008; G10H 2240/165; G10H 2210/145; G10H 2240/071; G10H 2250/595; G10H 2210/066; G10H 2240/131; G10H 2210/265; G10H 2210/105; G10H 2210/111; G10H 2210/115; G10H 1/361; G10H 1/0033; G10H 2240/141; G10H 5/007; G10H 1/16; G10H 2210/056; G10H 2210/031; G10H 5/06; G10H 1/0091; G10H 1/44; G10H 2210/036; G10H 2210/051; G10H 2210/471; G10H 2210/131; G10H 2210/155; G10H 1/02; G10H 1/0575; G10H 2210/061; G10H 2210/081; G10H 2240/135; G10H 3/125
See application file for complete search history.

(56) References Cited

U.S. PATENT DOCUMENTS 5,248,845 A * 9/1993 Massie ..... G10H 1/125 84/622

FOREIGN PATENT DOCUMENTS

| | | | | |
|---|---|---|---|---|
| CN | 114171037 A * | 3/2022 | | |
| WO | WO-9717692 A1 * | 5/1997 | ..... | G10H 5/007 |
| WO | WO-2004086353 A1 * | 10/2004 | ..... | G10H 1/043 |
| WO | WO-2006006901 A1 * | 1/2006 | ..... | G10H 1/0025 |
| WO | WO-2016166675 A1 * | 10/2016 | ..... | G10H 1/0091 |

* cited by examiner

*Primary Examiner* — Marlon T Fletcher
(74) *Attorney, Agent, or Firm* — RC Trademark Company

(57) ABSTRACT

Disclosed is a method for simulating a musical phrase, wherein the musical phrase includes a sequence of notes, the method comprising generating timbral fingerprints associated with a sample library that comprises recordings of a plurality of notes in a plurality of intensities, using a linear predictive coding technique, wherein the timbral fingerprints relate to the plurality of intensities of the plurality of notes; determining an origin intensity for the musical phrase, wherein the origin intensity is one intensity selected from amongst the plurality of intensities; and simulating each note in the sequence of notes, by morphing a recording of each note in the origin intensity according to timbral fingerprints of the note in the plurality of intensities, for simulating the musical phrase.

15 Claims, 2 Drawing Sheets

METHOD AND SYSTEM FOR SIMULATING MUSICAL PHRASE

TECHNICAL FIELD

The present disclosure relates to methods for simulating a musical phrase. The present disclosure also relates to systems for simulating a musical phrase.

BACKGROUND

Conventionally, different musical instruments are capable of producing a various number of musical notes. Moreover, each of these notes can be produced at different intensities of sound. Typically, a musical phrase comprises a sequence of notes that are produced individually at a respectively required intensity. In this regard, for simulating the sound of a musical phrase that replicates an original audio that is produced by a musical instrument, the sound of each note in the sequence of notes is to be produced at the respective required intensity.

However, the present techniques for simulating the musical phrase are highly resource intensive and costly, as they require each note to be triggered at possible intensities simultaneously and then requires crossfading between the different intensities as per requirement, which results in an unnatural or artificial sounding effect. Hence, this results in wastage of bandwidth and the CPU storage and memory components. Moreover, the present techniques may have notable differences between the recordings of the notes such as tuning or placement within the stereo image and thus, fail to effectively counter phasing or comb-filtering effects. Hence, simulating musical phrases with present techniques result in providing an unpleasant experience to the user where they might hear multiple sounds of the same note conflict with each other, due to intonation, vibration, or other performance differences.

Therefore, in the light of the foregoing discussion, there exists a need to overcome the aforementioned drawbacks associated with simulating a musical phrase.

SUMMARY

A first aspect of the present disclosure provides a method for simulating a musical phrase, wherein the musical phrase includes a sequence of notes, the method comprising:

- generating timbral fingerprints associated with a sample library that comprises recordings of a plurality of notes in a plurality of intensities, using a linear predictive coding technique, wherein the timbral fingerprints relate to the plurality of intensities of the plurality of notes;
- determining an origin intensity for the musical phrase, wherein the origin intensity is one intensity selected from amongst the plurality of intensities; and
- simulating each note in the sequence of notes, by morphing a recording of each note in the origin intensity according to timbral fingerprints of the note in the plurality of intensities, for simulating the musical phrase.

Advantageously, the method may effectively reduce the resources required as there is no need to trigger the notes at all possible intensities and crossfade between them, which leads to saving a lot of bandwidth and thus may make the method more cost efficient. Moreover, the method may effectively counter the problem of phasing or comb-filtering effects which provides a high-quality experience to a user listening to the sound of the simulated musical phrase.

The term "notes" as used herein refers to musical sounds, where the pitch and duration of a musical sound in a musical composition is represented by a note. For example, the notes may be double note, whole note, half note, quarter note or eighth note. The musical phrase includes the sequence of notes. Herein, optionally, the musical phrase includes the sequence of notes that occur (i.e., are present) between two rests. The term "rest" as used herein refers to a time duration during which no musical sound is being played. Optionally, the musical phrase may be in the form of musical sounds that are played on or produced by any musical instrument. Alternatively, the musical phrase may be in the form of vocal sounds. Herein, for simulating the musical phrase, a sound of each of the notes in the sequence of notes is to be produced at a required intensity. Optionally, the sound of the sequence of notes may be computer generated.

Optionally, the method further comprises creating the sample library comprising recordings of the plurality of notes in at least the plurality of intensities, prior to the step of generating the timbral fingerprints associated with the sample library. Optionally, in this regard, the sample library is stored in a data repository. The term "sample library" as used herein refers to a database in which the recording for every possible note at every possible intensity is stored. For example, the sample library may comprise recordings of 12 notes for a guitar at 4 different intensities i.e., for each of the 12 notes, 4 different recordings at 4 different intensities are stored.

Optionally, the recordings of the plurality of notes may also be stored for a plurality of lengths and/or a plurality of types. For each of the plurality of notes, multiple recordings for different lengths of time and/or different types are stored in the sample library. Optionally, the plurality of types for each of the plurality of notes may correspond to different styles of music such as semibreve, minim, etc.

Optionally, each recording amongst the recordings in the sample library is an audio generated by a musical instrument. In this regard, the recordings of the plurality of notes that are stored in the sample library are the sounds of the plurality of notes that may be produced by a musical instrument. Optionally, the musical instrument may be a guitar, a violin, a piano, a drum, etc.

Moreover, the method comprises generating timbral fingerprints associated with the sample library that comprises the recordings of the plurality of notes in the plurality of intensities, using a linear predictive coding technique, wherein the timbral fingerprints relate to the plurality of intensities of the plurality of notes. In simpler terms, the method comprises generating timbral fingerprints associated with the recordings of the plurality of notes in the plurality of intensities. The term "timbral fingerprints" as used herein refers to characteristics related to the sound waves of the recording for which the timbral fingerprint is generated. Herein, generating the timbral fingerprints associated with the recording allows to determine the characteristics of the sound waves for the recordings.

Optionally, the timbral fingerprints associated with the sample library comprise one or more of: frequency spectrums, envelopes, for the plurality of intensities of the plurality of notes in the recordings of the sample library. In this regard, the timbral fingerprints may contain information regarding one or more of the range of frequencies or the boundary within which an audio signal is contained for the recordings of different intensities of the plurality of notes.

The timbral fingerprints are generated for each of the plurality of notes at each of the plurality of intensities using the linear predictive coding technique. The phrase "linear predictive coding technique" as used herein refers to a method for processing the spectral envelope of a digital signal of the recording for which the timbral fingerprint is being generated. Linear predictive coding is generally performed using a linear predictive model. Herein, thus employing the linear predictive coding technique enables the synthesis and analyses of the spectral envelope of the recording for each of the plurality of notes at each of the plurality of intensities. Linear predictive coding technique is well known in the art.

Optionally, the linear predictive coding technique involves capturing a predefined number of frames starting from a midpoint of each of the recordings of the plurality of notes. In this regard, for performing synthesis of the spectral envelope, the linear predictive coding technique is needed to capture and analyze a certain number of frames from the recording of the particular note from the plurality of notes. Herein, the predefined number of frames are captured from the midpoint that allows to compensate for any silent frames in the start of the recording. The term "midpoint" as used herein refers to a middle portion of the recording. Optionally, the predefined number of frames may be 24 frames from the midpoint.

Optionally, the method further comprises:

encoding the timbral fingerprints; and storing the timbral fingerprints as a line spectral pair representation.

In this regard, the timbral fingerprints may be encoded in order to make them suitable for being represented as the line spectral pair. Herein, the line spectral representation is used to represent coefficients of the linear predictive coding technique for transmission over a channel. Optionally, the line spectral pair is a representation of a linear spectral pair polynomial that may consist of a location of roots of a palindromic polynomial and an antipalindromic polynomial of a linear pair polynomial. Optionally, the timbral fingerprints as the line spectral representation may be stored in a data repository.

Furthermore, the method comprises determining an origin intensity for the musical phrase, wherein the origin intensity is one intensity selected from amongst the plurality of intensities. In this regard, from the sample library where the recordings of the plurality of notes are stored for the plurality of intensities, a specific intensity is determined to be the origin intensity. The term "origin intensity" as used herein refers to a specific intensity from within the plurality of intensities, wherein the specific intensity is best suited for transitioning into other intensities of the plurality of intensities when implementing the step of simulating each note in the sequence of notes. Thus, the determination of the origin intensity ensures that minimal efforts are required for transitioning the recordings of the plurality of notes from one intensity to another intensity for simulating the musical phrase. Optionally, the origin intensity for the musical phrase is an origin intensity of a note in the musical phrase. The step of determining the origin intensity for the musical phrase may be implemented using one or more criteria as described below.

Optionally, the origin intensity for the musical phrase is:

an intensity that occurs most frequently in the musical phrase;

an intensity having a longest duration in the musical phrase;

an intermediate intensity in the musical phrase; or a highest intensity in the musical phrase.

In this regard, the above-mentioned parameters enable to determine the origin intensity which requires the least morphing for producing the required intensities for simulating the musical phrase. Herein, the intensity that occurs most frequently in the musical phrase is the intensity which is common for most notes in the sequence of notes. For example, in the musical phrase that changes the intensity from pp to mp, and then back to pp from mp, then pp is determined as the origin intensity since pp is the intensity that occurs most frequently. Alternatively, for the musical phrase that starts at intensity pp and then continues at intensity mp, then the origin intensity is determined to be mp as being the intensity having the longest duration in the musical phrase. Herein, the "intermediate intensity in the musical phrase" refers to the intensity of the notes that are sequentially present in the middle of the sequence of notes. Herein, the "highest intensity of the musical phrase" refers to the intensity that sounds loudest among all of the plurality of intensities.

Furthermore, the method comprises simulating each note in the sequence of notes, by morphing a recording of each note in the origin intensity according to timbral fingerprints of the note in the plurality of intensities, for simulating the musical phrase. Herein, for simulating a given note in the musical phrase, the recording of the given note in the origin intensity will be morphed in order to produce a sound of the given note that matches the intensity that is required for the musical phrase. In this regard, each of the sequence of notes in the musical phrase is individually morphed in its origin intensity to produce the intensity that is required to simulate the musical phrase. Thus, the method is resource friendly as the load on the processor is effectively reduced along with saving of bandwidth and memory components.

For example, in the musical phrase that is having 5 notes in the sequence of notes with the required intensities p, mp, mp, f, and pp respectively. Hence, the origin intensity is determined to be mp as being the intensity that occurs most frequently in the musical phrase. Subsequently, for simulating the musical phrase, the origin intensity is first morphed down from the origin intensity mp to the required intensity p using the timbral fingerprint of the said note, then remains in the origin intensity mp for the second and the third note in the sequence of notes, and then for simulating the fourth note and the fifth note, the origin intensity is morphed up to the required intensity f and pp respectively using the timbral fingerprints of the respective said notes.

Optionally, the step of morphing of the recording of each note in the origin intensity is performed by applying a timbral fingerprint of a required intensity of the note to the note in the origin intensity. In this regard, the information that is contained in the timbral fingerprints regarding a waveform that is produced for the sound of the note in the required intensity is then used to morph the waveform of the sound of the note in the origin intensity. Subsequently, morphing the note in the origin intensity using the timbral fingerprints of the note in the required intensity produces a resultant waveform replicating the sound of the note in the required intensity. This process is performed separately for each note, in the above manner, for accurately simulating each note in the musical phrase.

Optionally, the step of applying the timbral fingerprint of the required intensity of the note to the note in the origin intensity comprises applying a filter in a subtractive phase. In this regard, applying the timbral fingerprint may involve attenuating the waveform of the note in the origin note to produce the waveform that replicates the waveform of the note in the required intensity. Subsequently, the attenuation of the waveform of the note in the origin intensity may be done by applying the filter in the subtractive phase. Herein, by applying the filter in the subtractive phase, we eliminate the risk of boosting noise and other undesirable effects to unacceptable levels.

Optionally, the method further comprises:

determining a root mean square (RMS) measurement of a natural perceived loudness of each recording; and tagging each recording with its corresponding RMS measurement.

In this regard, the term "natural perceived loudness" as used herein refers to how much a sound is naturally perceived to be loud or quiet. Herein, determining the root mean square measurement of the natural perceived loudness of each of the recordings allows one to determine the electric power the recording creates over time. Hence, the natural perceived loudness of each of the recordings is well known in the method, and thus, can be used whenever required for morphing the origin intensity.

Optionally, the required intensity of the note whose recording in the origin intensity is to be morphed, is equal to the RMS measurement of a natural perceived loudness of the recording.

A second aspect of the present disclosure provides a system for simulating a musical phrase, wherein the musical phrase includes a sequence of notes occurring between two rests, the system comprising:

a data repository; and a processor configured to:

generate timbral fingerprints associated with a sample library that comprises recordings of a plurality of notes in a plurality of intensities, using a linear predictive coding technique, wherein the timbral fingerprints relate to the plurality of intensities of the plurality of notes, the sample library being stored in the data repository;

determine an origin intensity for the musical phrase, wherein the origin intensity is one intensity selected from amongst the plurality of intensities; and simulate each note in the sequence of notes, by morphing a recording of each note in the origin intensity according to timbral fingerprints of the note in the plurality of intensities, for simulating the musical phrase.

The term "data repository" as used herein refers to a hardware device, also known as storage, storage medium, digital data repository, or storage media that may store information either temporarily or permanently. Generally, the data repository stores data, files, and the like in any format. The data repository can be used either internally or externally depending upon the requirement of the control unit to store data. Beneficially, the stored data can be used to determine the optimum working of the method to make the system faster and more efficient by having at least one pre-set data configuration of the system in the data repository wherein there is no need to rely on data stored in an external memory or external server system.

The data repository may include, but is not limited to, an electronic storage device, a magnetic storage device, an optical storage device, an electromagnetic storage device, a semiconductor storage device, or any suitable combination of the foregoing. Examples of implementation of data repository, but are not limited to, Electrically Erasable Programmable Read-Only Memory (EEPROM), Random Access Memory (RAM), Read Only Memory (ROM), Hard Disk Drive (HDD), Flash memory, a Secure Digital (SD) card, Solid-State Drive (SSD), a computer readable storage medium, and/or CPU cache memory.

The term "processor" as used herein refers to a computational element that is operable to respond to and process instructions given by the user and to control operations of the apparatus. Examples of the processor include, but are not limited to, a microprocessor, a microcontroller, a complex instruction set computing (CISC) microprocessor, a reduced instruction set (RISC) microprocessor, a very long instruction word (VLIW) microprocessor, or any other type of processing circuit. Furthermore, the processor may refer to one or more individual processors, processing devices and various elements associated with a processing device that may be shared by other processing devices. Additionally, one or more individual processors, processing devices and elements are arranged in various architectures for responding to and processing the instructions that drive the apparatus. It will be appreciated that each apparatus is configured to have the processor therein. Subsequently, the images captured by the at least one sensor are converted to electrical signals which are then received by the processor.

Optionally, in the system, each recording amongst the recordings in the sample library is an audio generated by a musical instrument.

Optionally, in the system, the timbral fingerprints associated with the recordings comprise one or more of: frequency spectrums, envelopes, for the intensities of the plurality of notes in the recordings.

Optionally, in the system, the linear predictive coding technique involves capturing a predefined number of frames starting from a midpoint of each of the recordings of the plurality of notes.

Optionally, in the system, the origin intensity for the musical phrase is:

an intensity that occurs most frequently in the musical phrase;

an intensity having a longest duration in the musical phrase;

an intermediate intensity in the musical phrase; or a highest intensity in the musical phrase.

Optionally, the processor is configured to morph the recording of each note in the origin intensity by applying a timbral fingerprint of a required intensity of the note to the note in the origin intensity.

Optionally, the processor is configured to apply the timbral fingerprint of the required intensity of the note to the note in the origin intensity by applying a filter in a subtractive phase.

Optionally, the processor is further configured to:

encode the timbral fingerprints; and store the timbral fingerprints as a line spectral pair representation.

Optionally, the processor is further configured to:

determine a root mean square (RMS) measurement of a natural perceived loudness of each recording; and tag each recording with its corresponding RMS measurement.

Optionally, the processor is further configured to create the sample library comprising the recordings of the plurality of notes in the plurality of intensities, prior to the generation of the timbral fingerprints associated with the sample library.

BRIEF DESCRIPTION OF THE DRAWINGS

One or more embodiments of the present disclosure will now be described, by way of example only, with reference to the accompanying drawings, in which.

DETAILED DESCRIPTION

Figure 1:
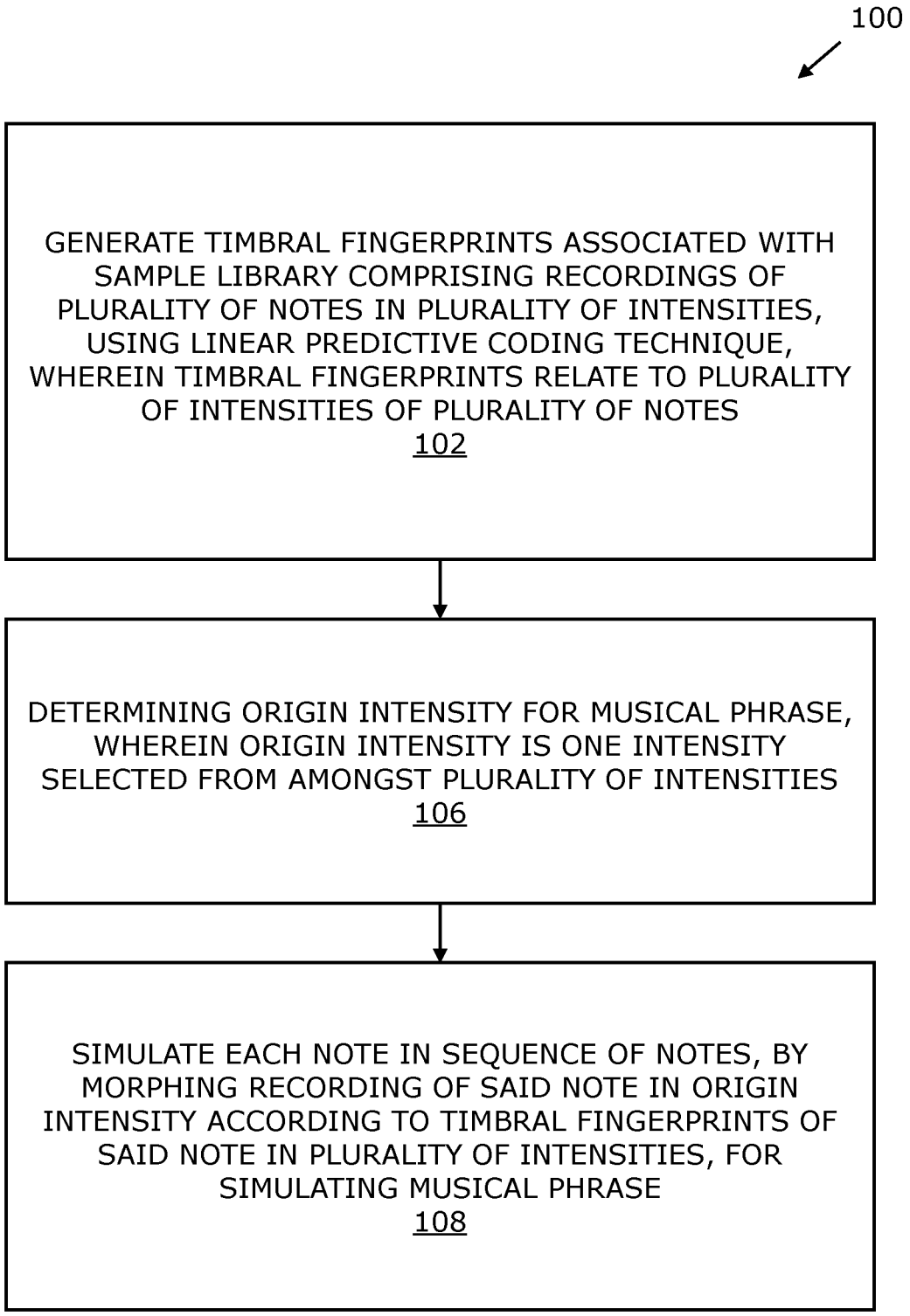
FIG. 1 is a flowchart illustrating steps of a method for simulating a musical phrase, in accordance with an embodiment of the present disclosure.

Referring to FIG. 1, illustrated is a flowchart for depicting steps of a method 100 for simulating a musical phrase, in accordance with an embodiment of the present disclosure. The musical phrase includes a sequence of notes. At step 102, timbral fingerprints associated with a sample library that comprises recordings of a plurality of notes in a plurality of intensities are generated, using a linear predictive coding technique, wherein the timbral fingerprints relate to the plurality of intensities of the plurality of notes. At step 104, an origin intensity for the musical phrase is determined, wherein the origin intensity is one intensity selected from amongst the plurality of intensities. At step 106, each note in the sequence of notes is simulated, by morphing a recording of each note in the origin intensity according to timbral fingerprints of the note in the plurality of intensities, for simulating the musical phrase.

The steps 102, 104, and 106 are only illustrative and other alternatives can also be provided where one or more steps are added, one or more steps are removed, or one or more steps are provided in a different sequence without departing from the scope of the claims herein.

Figure 2:
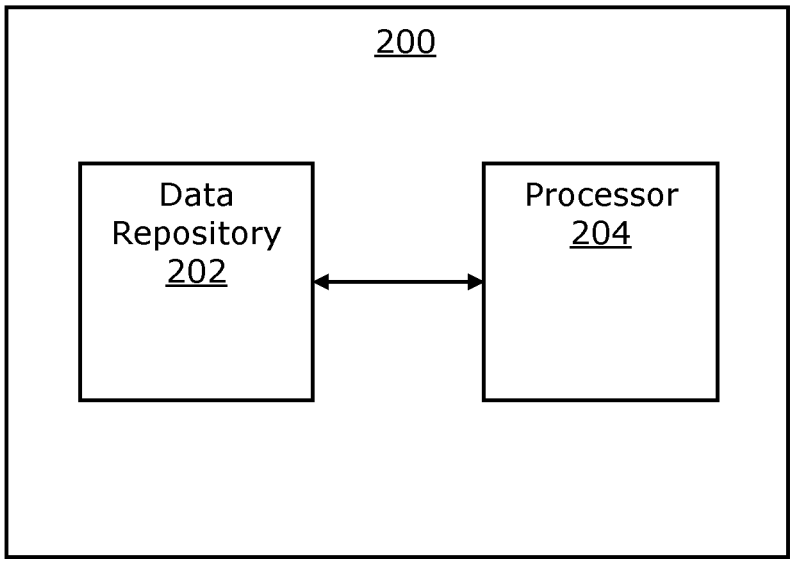
FIG. 2 is a block diagram of a system for simulating a musical phrase, in accordance with an embodiment of the present disclosure.

Referring to FIG. 2, illustrated is a block diagram of a system 200 for simulating a musical phrase, in accordance with an embodiment of the present disclosure. The musical phrase includes a sequence of notes. As shown, the system 200 comprises a data repository 202 and a processor 204. The processor 204 is configured to: generate timbral fingerprints associated with a sample library that comprises recordings of a plurality of notes in a plurality of intensities; determine an origin intensity for the musical phrase; and simulate each note in the sequence of notes. Herein, the data repository 202 is communicably coupled to the processor 204, for receiving and storing the sample library that is created by the processor 204.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Expressions such as "may" and "can" are used to indicate optional features, unless indicated otherwise in the foregoing. Reference to the singular is also to be construed to relate to the plural.

What is claimed is:

1. A method for simulating a musical phrase, wherein the musical phrase includes a sequence of notes, the method comprising:

generating timbral fingerprints associated with a sample library that comprises recordings of a plurality of notes in a plurality of intensities, using a linear predictive coding technique, wherein the timbral fingerprints relate to the plurality of intensities of the plurality of notes;

determining an origin intensity for the musical phrase, wherein the origin intensity is one intensity selected from amongst the plurality of intensities; and simulating each note in the sequence of notes, by morphing a recording of each note in the origin intensity according to timbral fingerprints of the note in the plurality of intensities, for simulating the musical phrase, wherein the linear predictive coding technique involves capturing a predefined number of frames starting from a midpoint of each of the recordings of the plurality of notes.

2. The method according to claim 1, wherein each recording amongst the recordings in the sample library is an audio generated by a musical instrument.

3. The method according to claim 1, wherein the timbral fingerprints associated with the recordings comprise one or more of: frequency spectrums, envelopes, for the intensities of the plurality of notes in the recordings.

4. The method according claim 1, wherein the origin intensity for the musical phrase is:

an intensity that occurs most frequently in the musical phrase;

an intensity having a longest duration in the musical phrase;

an intermediate intensity in the musical phrase; or a highest intensity in the musical phrase.

5. The method according to claim 1, wherein the step of morphing of the recording of each note in the origin intensity is performed by applying a timbral fingerprint of a required intensity of the note to the note in the origin intensity.

6. The method according to claim 5, wherein the step of applying the timbral fingerprint of the required intensity of the note to the note in the origin intensity comprises applying a filter in a subtractive phase.

7. The method according to claim 1, further comprising:

encoding the timbral fingerprints; and storing the timbral fingerprints as a line spectral pair representation.

8. The method according to claim 1, further comprising:

determining a root mean square (RMS) measurement of a natural perceived loudness of each recording; and tagging each recording with its corresponding RMS measurement.

9. The method according claim 1, further comprising creating the sample library comprising the recordings of the plurality of notes in the plurality of intensities, prior to the step of generating the timbral fingerprints associated with the sample library.

10. A system for simulating a musical phrase, wherein the musical phrase includes a sequence of notes, the system comprising:

a data repository; and a processor configured to:

generate timbral fingerprints associated with a sample library that comprises recordings of a plurality of notes in a plurality of intensities, using a linear predictive coding technique, wherein the timbral fingerprints relate to the plurality of intensities of the plurality of notes, the sample library being stored in the data repository;

determine an origin intensity for the musical phrase, wherein the origin intensity is one intensity selected from amongst the plurality of intensities; and simulate each note in the sequence of notes, by morphing a recording of each note in the origin intensity according to timbral fingerprints of the note in the plurality of intensities, for simulating the musical phrase, wherein the linear predictive coding technique involves capturing a predefined number of frames starting from a midpoint of each of the recordings of the plurality of notes.

11. The system according to claim 10, wherein the processor is configured to morph the recording of each note in the origin intensity by applying a timbral fingerprint of a required intensity of the note to the note in the origin intensity.

12. The system according to claim 11, wherein the processor is configured to apply the timbral fingerprint of the required intensity of the note to the note in the origin intensity by applying a filter in a subtractive phase.

13. The system according to claim 10, wherein the processor is further configured to:

encode the timbral fingerprints; and store the timbral fingerprints as a line spectral pair representation.

14. The system according to claim 10, wherein the processor is further configured to:

determine a root mean square (RMS) measurement of a natural perceived loudness of each recording; and tag each recording with its corresponding RMS measurement.

15. The system according to claim 10, wherein the processor is further configured to create the sample library comprising the recordings of the plurality of notes in the plurality of intensities, prior to the generation of the timbral fingerprints associated with the sample library.

* * * * *